United States Patent [19]

Allen

[11] 4,440,115

[45] Apr. 3, 1984

[54] FUEL TREATING APPARATUS FOR INTERNAL COMBUSTION ENGINES AND METHOD OF OPERATING SAME

[76] Inventor: James O. Allen, 1600 W. 7th St., Peoria, Ill. 61605

[21] Appl. No.: 334,315

[22] Filed: Dec. 27, 1981

[51] Int. Cl.[3] ..... F02B 75/12

[52] U.S. Cl. ..... 123/1 A; 123/198 A; 123/23; 44/66

[58] Field of Search ..... 123/1 A, 198 A, 23, 123/3; 44/66

[56] References Cited

U.S. PATENT DOCUMENTS

| | | | |
|---|---|---|---|
| 61,662 | 1/1867 | Holden | 44/66 |
| 663,370 | 12/1900 | Taylor et al. | 44/66 |
| 1,692,784 | 11/1928 | Orelup et al. | 44/66 |
| 3,963,000 | 6/1976 | Kosaka et al. | 123/1 A |

FOREIGN PATENT DOCUMENTS

| | | | |
|---|---|---|---|
| 2455315 | 5/1976 | Fed. Rep. of Germany | 123/1 A |
| 1513051 | 6/1978 | United Kingdom | 123/1 A |

*Primary Examiner*—Charles J. Myhre
*Assistant Examiner*—E. Rollins Cross
*Attorney, Agent, or Firm*—Bernard L. Kleinke

[57] ABSTRACT

A method of operating an internal combustion engine, includes adding to the fuel being supplied to the engine, a combustible oil or grease in a minor proportion of the weight of the fuel. The oil preferably is a member selected from the group consisting of petroleum oil and vegetable oil, and the grease preferably is a member selected from the group consisting of petroleum grease and animal fat grease. The apparatus for use with the internal combustion engine includes a reservoir device for storing a quantity of the fuel additive, and a mixing device which disperses small quantities of the additive, received from the reservoir device, with fuel flowing therethrough to form a fuel mixture for use in the engine.

8 Claims, 3 Drawing Figures

FUEL TREATING APPARATUS FOR INTERNAL COMBUSTION ENGINES AND METHOD OF OPERATING SAME

DESCRIPTION

TECHNICAL FIELD

The present invention relates in general to fuel-saving apparatus for internal combustion engines and a method of operating same, and it more particularly relates to such apparatus which is adapted to be used with internal combustion engines for powering vehicles.

BACKGROUND ART

With the ever-increasing cost and shortage of petroleum products, various different types and kinds of devices and fuel additives have been used with internal combustion engines to conserve on fuel consumption. For example, alcohol has been added to gasoline to serve as an extender. The alcohol is made from renewable resources, such as agricultural products. However, the alcohol is expensive to manufacture and does not materially improve fuel economy.

Therefore, it would be highly desirable to have a substance used as an additive to fuel, such as gasoline, to provide greater fuel economy, by greatly reducing fuel consumption. It would be desirable further to have an additive that would provide greater fuel efficiency of the engine by increasing greatly the miles per gallon of fuel when used in a vehicle.

DISCLOSURE OF INVENTION

Therefore, the principal object of the present invention is to provide a new and improved apparatus for improving the fuel economy of an internal combustion engine.

Another object of the present invention is to provide a new and improved method of operating an internal combustion engine, which greatly improves the fuel efficiency thereof and which involves a fuel additive made from renewable sources or other resources as well.

Briefly, the above and further objects of the present invention are realized by a method of adding to the fuel being supplied to the engine, a combustible oil or grease in a minor proportion of the weight of the fuel. The oil preferably is a member selected from the group consisting of petroleum oil and vegetable oil, and the grease preferably is a member selected from the group consisting of petroleum grease and animal fat grease.

The apparatus for use with the internal combustion engine includes a reservoir device for storing a quantity of the fuel additive, and a mixing device which disperses small quantities of the additive, received from the reservoir device, with fuel flowing therethrough to form a fuel mixture for use in the engine.

The fuel additive of the present invention is a slow burning substance or material to enable the fuel to be consumed more economically. The additive is made of readily available materials from renewable resources.

BRIEF DESCRIPTION OF DRAWINGS

The above-mentioned and other objects and features of this invention and the manner of attaining them will become apparent, and the invention itself will be best understood with reference to the following description of preferred embodiments of the invention taken in conjunction with the accompanying drawings, wherein.

BEST MODE FOR CARRYING OUT THE INVENTION

Figure 1:
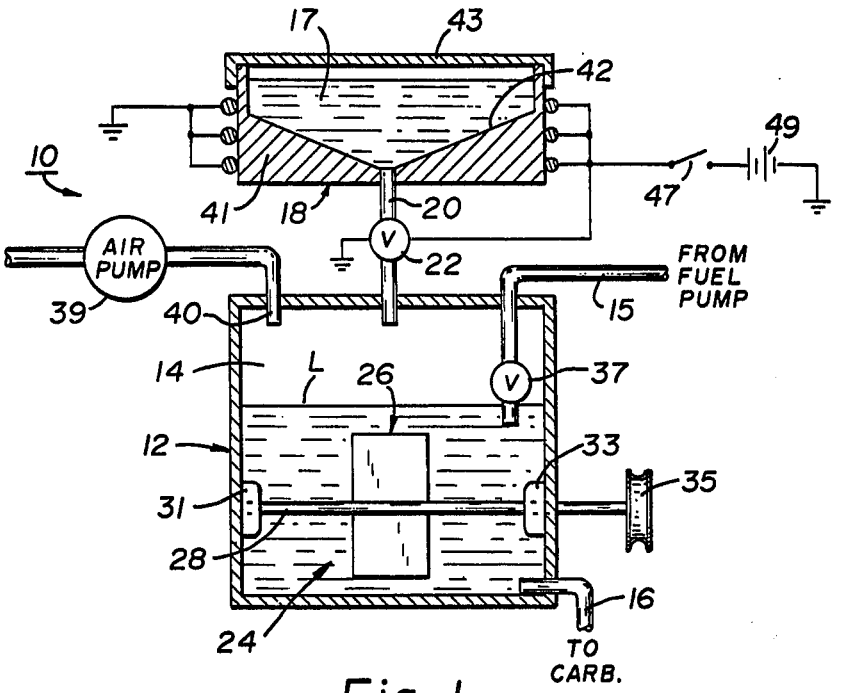
FIG. 1 is a schematic drawing of an apparatus, which is constructed in accordance with the present invention.

Referring now to FIG. 1 of the drawings, there is shown an apparatus 10, which is constructed in accordance with the present invention, and which is adapted to be used with an internal combustion engine (not shown). The apparatuses shown and described herein are preferably used with an internal combustion engine for powering a vehicle (not shown), but it is to be understood that the apparatus of the present invention can be used with other engines as well.

The apparatus 10 generally comprises mixing equipment 12 which has a mixing chamber 14 therein for receiving fuel via a fuel line 15, through which fuel is pumped from a fuel tank (not shown) by means of a fuel pump (not shown) for the vehicle, to an outlet line 16 connected in fluid communication between the mixing compartment 14 and a carburetor (not shown) for the vehicle. A slow burning combustible substance 17 stored in a reservoir 18 is fed, under the force of gravity, to a conduit 20, through a solenoid-operated valve 22 to the mixing compartment 14, so that the material can be dispersed by means of an agitator 24 with the fuel flowing through the mixing chamber 14.

In operation, when the vehicle engine is functioning, fuel is pumped via the vehicle's fuel pump through the fuel line 15 and into the mixing compartment 14. Small quantities of the slow-burning combustible substance 17 are continuously admitted to the mixing compartment 14 from the reservoir 18 via the conduit 20 and the valve 22. In this regard, the substance 17 is delivered under the force of gravity at a very slow rate, drop by drop, to the fuel flowing through the mixing compartment 14.

The agitator 24 disperses the substance 17 with the fuel contained within the mixing compartment 14 via the fuel line 16. The fuel mixture flows from the mixing compartment 14 to the vehicle carburetor.

The fuel mixture adds greatly to the operational efficiency of the internal combustion engine, by substantially reducing fuel consumption. The addition of the slow-burning combustible substance 17 to form the mixture entering the carburetor, enables the mixture to be consumed more completely and more thoroughly, and to achieve a more efficient operation of the vehicle.

The slow-burning substance 17 is an additive for the fuel, and compresses a combustible oil or grease, which is added to the fuel in a minor proportion of the weight of the fuel. More particularly, the additive is a member of the group consisting of petroleum oil, petroleum grease, vegetable oil, and animal fat grease.

It has been determined that the following types of oil have each exhibited the desired properties: motor oil, brake oil, corn oil, mineral oil, kerosene, cod liver oil, baby oil, and linseed oil. The following types of grease have each exhibited the desired properties: bacon grease and vaseline petroleum jelly.

The quantity of the additive depends upon the condition, age and make of the vehicle. Thus, the exact quantity is determined by the user, through trial and error, to provide the best possible fuel economy for a given vehicle. In this regard, the quantity of substance 17 entering the fuel compartment can be adjusted by opening or closing the orifice (not shown) of the valve 22 to a greater or lesser extent.

The following are examples of the composition of the substance 17.

EXAMPLE 1

1 part by volume animal fat grease (bacon grease)
1 part by volume vegetable oil This example is the preferred example. The vegetable oil is mixed with heated animal fat to help provide and maintain the substance 17 with a smooth consistency, since the animal fat grease otherwise tends to clump together. The vegetable oil is an oil sold under the registered trade mark WESSON, by Hunt Wesson Foods, Inc. of Fufferton, Calif.

Figure 2:
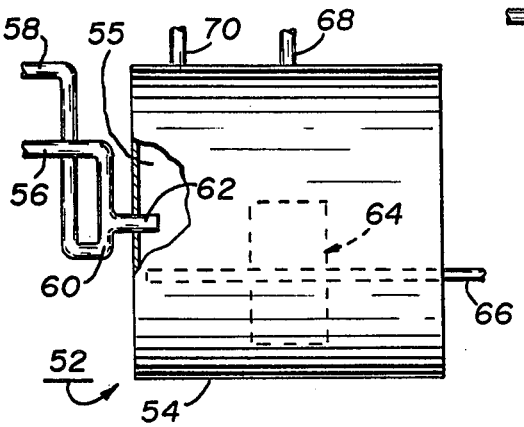
FIG. 2 is a schematic drawing of another apparatus, which is also constructed in accordance with the present invention.

In an actual test conducted, using the foregoing-mentioned Example 1 form of the substance 17, with an eight-year old 1973 Chevrolet Impala automobile having run approximately 95,000 miles, and having a V-8 engine, by means of the inventive apparatus substantially as shown in FIG. 2, a gasoline consumption rate of about 30 to 35 miles to the gallon was realized.

EXAMPLE 2

1 pint animal fat grease
6–7 oz. high octane gasoline

The animal fat grease is approximately 90% by volume of bacon grease mixed with approximately 10% by volume of other miscellaneous meat grease. The gasoline is mixed with the animal fat grease to help provide and maintain the substance 17 with a smooth consistency, since the animal fat otherwise tends to clump together. The automobile used in the experiment ordinarily obtained 14–16 miles per gallon in efficiency, without the use of the inventive apparatus, and without the use of the inventive substance 17. The grease is heated to liquify it prior to mixing with the gasoline.

For the foregoing experimental vehicle, the preferred rate of addition of the substance 17 to the gasoline, for the substance of Example 1, is approximately 0.1 to 0.5, and preferably 0.2 ounces per minute, at about 65° F. ambient temperature. The rate of addition of the substance of Example 2, is approximately 0.075 to 0.2, and preferably 0.125 ounces per minute, at about 65° F. ambient temperature.

Representative other addition rates, each of which were measured at approximately 50° F., are as follows:

| Substance | Rate (oz. per min.) |
|---|---|
| kerosene | 0.1–0.6 (preferably 0.40) |
| mineral oil | 0.1–0.6 (preferably 0.40) |
| linseed oil | 0.09–0.5 (preferably 0.30) |
| brake oil fluid | 0.1–0.6 (preferably 0.40) |

Considering now the agitator 24 in greater detail, the agitator 24 includes a paddle 26 mounted on a shaft 28 journaled for rotation about its ends 31 and 33 within the mixing chamber 14. The agitator effectively dispenses or "beats" the substance into the gasoline within the mixing compartment to help prevent, or eliminate, precipitation of the substance 17 within the mixing compartment 14.

In order to drive the agitator 24, a pulley 35 is mounted on an external end of the shaft 28 to drive it about its axis by means of a belt (not shown) driven by the internal combustion engine, or other convenient source of power, such as an electric motor (not shown). It should be noted that the shaft 28 is sealed by a suitable shaft seal (not shown) at the interior of the mixing compartment 14.

A stop valve or float valve 37 is disposed within the interior of the mixing chamber 14 at a fluid inlet 38 to limit the amount of fuel entering the mixing chamber 14 to a level L as indicated in FIG. 1. In this manner, there is always a space between the level L and the upper portion of the mixing compartment 16 to receive the additive entering the mixing compartment 14.

An air pump 39 supplies air under pressure to the interior of the mixing compartment 14 via an air inlet 40 to help force the substance-fuel mixture from the mixing chamber.

Considering now the reservoir 18 in greater detail, the reservoir 18 includes a cylindrical open top container 41 having a conically-shaped bottom wall 42 for receiving and storing the additive 17 therein. A closure or cover 43 is disposed over the open top of the container 41. An electrical heating coil surrounds a portion of the exterior surface of the container 41, to maintain the additive 17 in a molten condition so that it can remain flowable even at cold ambient temperatures. A thermostat (not shown) is connected to the heating elements to de-energize them at higher ambient temperatures.

A manual switch 47, when closed, connects the vehicle battery 49 to the valve 22 to cause it to open, and to the electrical heating elements to energize them, while the vehicle engine is running. When the engine is turned off, the switch 47 is then opened manually, to de-energize the heating elements and to close the valve 22. Thus, the substance 17 is retained in the reservoir and is not heated while the vehicle is not in use.

Referring now to FIG. 2 of the drawings, there is shown an apparatus 52, which is constructed also in accordance with the present invention, and which is similar to the apparatus 10, except for the manner of conveying fuel into and out of it.

The apparatus 52 generally comprises a mixing equipment 54 having a mixing chamber 55. Equipment 54 is generally similar to the mixing equipment 12. An inlet fuel line 56 is connected upstream in fluid communication with a vehicle fuel pump (not shown) to convey fuel under pressure therethrough, in a similar manner as the line 15 is connected to its vehicle pump, to supply fuel under pressure to the interior of the mixing equipment 54. An outlet fuel line 58 conveys the fuel mixture from the mixing tank in a similar manner as the fuel line 16 of the apparatus 10. A T-connector 60 interconnects the inlet and outlet fuel lines 56 and 58 in fluid communication to a port 62. Thus, when fuel flows in the inlet line 56, it fills the mixing chamber 55.

An agitator 64 serves a similar purpose as the agitator 26 of the apparatus 10 and disperses additive with the fuel. The agitator 64 includes a shaft 66 journaled for rotation in a similar manner as the shaft 28, and extends out of the mixing tank 54 and is driven by any suitable technique, such as by a pulley (not shown) driven by the engine (not shown).

An additive inlet 68 conveys a substance (not shown) to serve as an additive, from a reservoir (not shown) via a solenoid-actuated valve (not shown) similar to the reservoir 18 and the valve 22, the substance being the same as the substance 17. An air inlet 70 is similar to the air inlet 40 and is connected in fluid communication with an air pump (not shown) similar to the air pump 39, for the same purposes.

In operation, the additive is continuously dispersed thoroughly within the mixing chamber by the agitator 64 to form an additive fuel mixture in a similar manner as the apparatus 10. The mixture continuously migrates out of the mixing chamber 55 via the port 62. Furthermore, the air pumped into the mixing chamber helps force the mixture from the mixing chamber.

Figure 3:
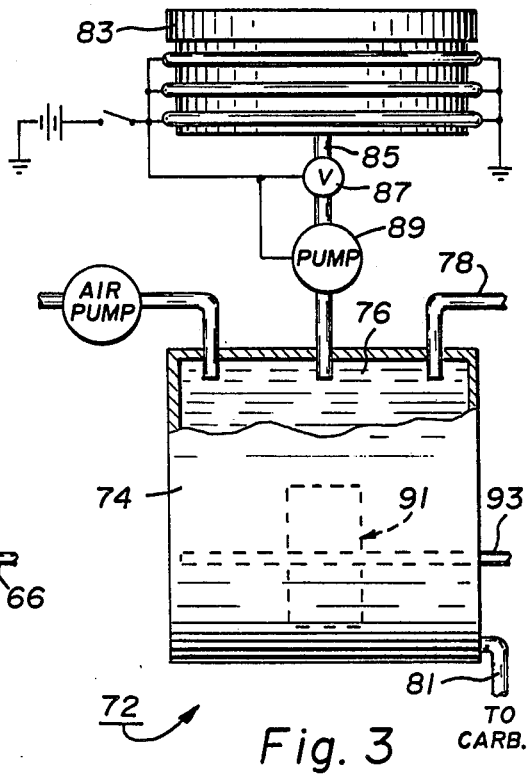
FIG. 3 is a fragmentary partly schematic view of still another apparatus, which is constructed in accordance with the present invention.

Referring now to FIG. 3, there is shown an apparatus 72, which is constructed in accordance with the present invention, and which is generally similar to the apparatus 10 of FIG. 1, except for the manner of conveying the substance to the mixing equipment. The apparatus 70 includes a mixing equipment 74, which is generally similar to the mixing equipment 12 and which has a mixing chamber 75 for receiving a substance to serve as an additive for fuel received from an inlet fuel line 78, the substance 75 being the same as the substance 17. An outlet fuel line 81 conveys fuel mixture from the fuel tank 74 in a similar manner as the fuel line 16.

A reservoir 83, similar to the reservoir 18, is adapted to store the additive, and has a conduit 85 for conveying the additive from the reservoir 83 through a solenoid-actuated valve 87, which is similar to the solenoid actuated valve 22 of the apparatus 10. A metering pump 89 is connected in fluid communication between the valve 87 and the mixing chamber to supply the substance from the reservoir via the valve 87 to the mixing chamber 14. An agitator 91 mounted on an engine-driven shaft 93 serves to disperse the additive with the fuel in a similar manner as the agitator 24.

While particular embodiments of the present invention have been disclosed, it is to be understood that various different modifications are possible and are contemplated within the true spirit and scope of the appended claims. For example, various different types and kinds of material, such as metal, plastic, or the like, can be used for the construction of the various elements of the apparatus. There is no intention, therefore, of limitations to the exact abstract or disclosure herein presented.

I claim:

1. Apparatus for treating fuel continuously being supplied to an internal combustion engine, having a fuel line through which fuel is pumped, comprising; reservoir means for storing a quantity of a liquid fuel additive, said reservoir means having an outlet; mixing means having an additive inlet and a mixing chamber connected in fluid communication with the engine fuel line, said additive inlet communicating with said mixing chamber and communicating with the reservoir outlet; agitating means mounted in said mixing chamber for dispersing small quantities of additive supplied from said reservoir means through said additive inlet with fuel flowing under pressure from the fuel line through said mixing chamber to form a fuel mixture for use in the engine; means connected in fluid communication between said reservoir outlet and said additive inlet for conveying said fuel additive to said mixing chamber; outlet means connected in fluid communication with said mixing chamber for supplying continuously said fuel mixture to the engine; wherein said mixing means includes a pressurizing fluid inlet, further including fluid pumping means for supplying fluid under pressure to said fluid inlet in sufficient quantity to force said fuel mixture from said mixing chamber to said outlet means; further including said additive stored in said reservoir means, said additive being a combustible oil or grease, which is added to fuel, flowing through said mixing chamber, in a minor proportion of the weight of said fuel; further including means mounted on said reservoir means for heating said additive in said reservoir means to maintain said additive in a flowable state; and wherein said additive conveying means includes valve means connected in fluid communication between said reservoir outlet and said additive inlet for controlling the flow of said additive from said reservoir means to said mixing means.

2. Apparatus according to claim 1, wherein said mixing means includes a fuel inlet connected in fluid communication with said mixing chamber and adapted to be connected in fluid communication with the fuel line, further including float-actuated stop valve means mounted at said fuel inlet for limiting the quantity of fuel entering said fuel port of said mixing means so that an air space is provided to permit said additive to enter said mixing chamber.

3. Apparatus according to claim 1, wherein said additive conveying means includes pump means for conveying additive from said reservoir means forcibly into said mixing means.

4. Apparatus according to claim 1, further including said additive stored in said reservoir, said additive being a member selected from the group consisting of petroleum oil, petroleum grease, vegetable oil, and animal fat grease.

5. Apparatus according to claim 1, wherein said agitating means includes a shaft journalled for rotation about its ends, and a paddle mounted on said shaft for dispersing the substance into the fuel to prevent or at least to retard the precipitation of the substance into the fuel.

6. Apparatus according to claim 4, wherein said petroleum oil is a member selected from the group consisting of kerosene, mineral oil, linseed oil, and brake oil fluid.

7. Apparatus according to claim 4, wherein said substance comprises one part by volume of animal fat grease, and one part by volume of vegetable oil.

8. Apparatus according to claim 4, wherein said substance comprises a mixture consisting of animal fat grease and high octane gasoline.

* * * * *